United States Patent [19]

Benaroya

[11] Patent Number: 4,678,407

[45] Date of Patent: Jul. 7, 1987

[54] MULTI-TANDEM FREE PISTON MACHINE

[76] Inventor: Henry Benaroya, 41, Bld Commandant Charcot, 92200 Neuilly sur Seine, France

[21] Appl. No.: 237,128

[22] PCT Filed: Jun. 23, 1980

[86] PCT No.: PCT/FR80/00097

§ 371 Date: Feb. 17, 1981

§ 102(e) Date: Feb. 17, 1981

[87] PCT Pub. No.: WO81/00019

PCT Pub. Date: Jan. 8, 1981

[30] Foreign Application Priority Data

Jun. 25, 1979 [FR] France ..... 79 16295

[51] Int. Cl.[4] ..... F01B 7/02; F01B 1/00

[52] U.S. Cl. ..... 417/341; 92/75; 92/146

[58] Field of Search ..... 417/310, 341; 123/46 R, 123/46 B; 92/146, 75, 69

[56] References Cited

U.S. PATENT DOCUMENTS

| | | | |
|---|---|---|---|
| 2,812,894 | 11/1957 | Schweitzer | 417/341 |
| 2,945,618 | 7/1960 | Endres | 417/341 |
| 3,347,215 | 10/1967 | Pescara | 417/340 X |
| 3,669,571 | 6/1972 | Benaroya | 417/341 |

FOREIGN PATENT DOCUMENTS

| | | | |
|---|---|---|---|
| 771966 | 4/1957 | United Kingdom | 123/46 B |

*Primary Examiner*—Leonard E. Smith

*Attorney, Agent, or Firm*—John T. Synnestvedt; Albert L. Free

[57] ABSTRACT

A free piston machine comprising a mounting, an inner movable mechanism comprising a central cross-member and guided in translation so as to be able to move with an alternating motion along the axis of the mounting and an outer movable mechanism comprising two outer cross-members connected by at least one tie-rod. The mounting includes a base (10) and a header (11) connected by at least one central one-piece structure. The inner movable mechanism comprises four inner drive pistons movable along drive cylinders (15*a*–15*b*) arranged at the corners of a rectangle and two compressor pistons sliding in compressor cylinders (17*a*–17*b*) whose axles pass outside of said rectangle.

10 Claims, 7 Drawing Figures

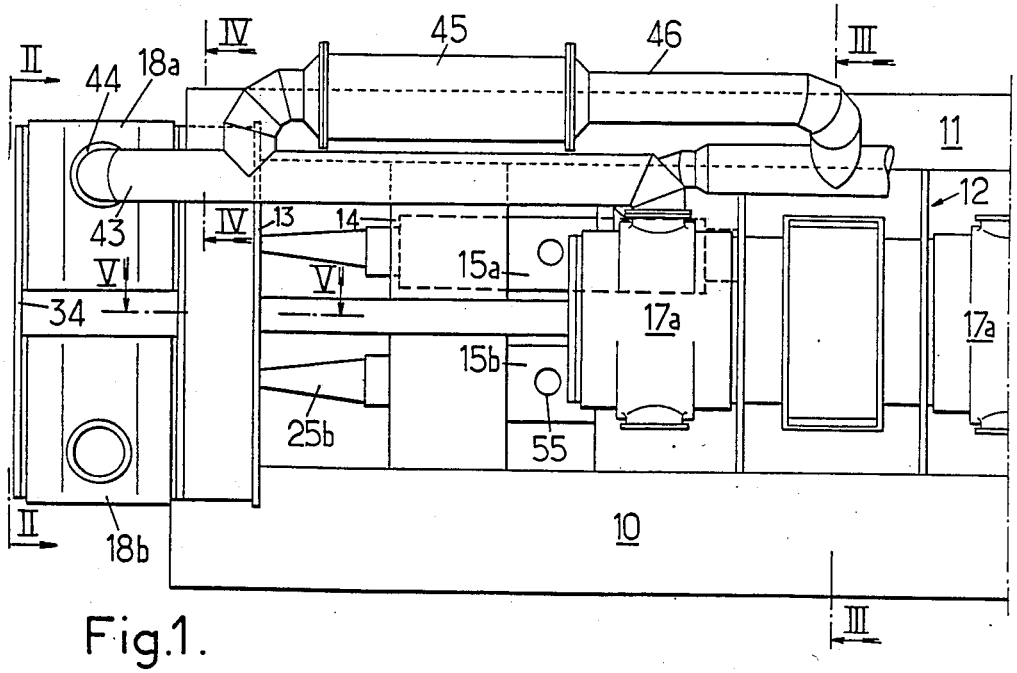
Fig.1.
Fig. 2.
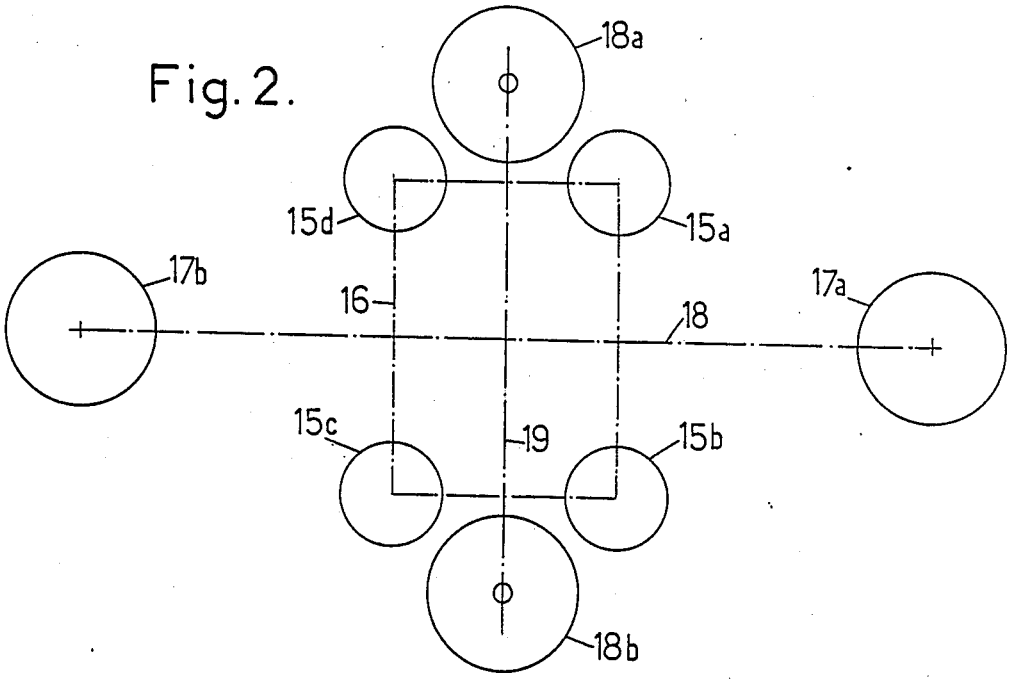

MULTI-TANDEM FREE PISTON MACHINE

The present invention relates to multi-tandem free piston machines, comprising several pairs of parallel drive cylinders, each cylinder containing two opposite free drive pistons, fastened to compressor pistons.

The invention relates more particularly to a multi-tandem free piston machine comprising a mounting, an inner movable mechanism comprising a central cross-member transversal to an axis of the mounting, guided in translation so as to be movable with an alternating movement along said axis, bearing, on each side, four inner drive pistons movable along drive cylinders arranged at the corners of a rectangle and two compressor pistons sliding in inner compressor cylinders of which the axles pass outside said rectangle, an outer movable mechanism comprising two outer cross-members connected by at least one tie-rod, each bearing four outer drive pistons movable in four of said drive cylinders and two compressor pistons sliding in outer compressor cylinders, and synchronising means for the alternating movement of the two mechanisms.

The invention is directed at providing a multi-tandem machine whose frame has very high rigidity, ensuring satisfactory guidance of the mechanisms whilst permitting easy dismounting of the cylinders, notably of the cylinders which have a large axial size.

With this object, the invention proposes a machine in which the mounting comprises a base, an upper header and two frames connecting the base and the header, arranged symmetrically with respect to a middle plane of the mounting and on which the outer compressor cylinders are fixed through their face turned towards the middle plane, the opposite faces of said outer compressor cylinders being connected by plates.

The invention finds particularly important application in energy-producing installations comprising a free piston machine, a gas turbine which receives the exhaust gases from the drive cylinders and a compressor which provides the compressor cylinders with air at a pressure above atmospheric pressure through a conventional cooler. In this case, in fact, each frame may be designed to constitute, with the base, the header and a casing which bounds a space containing the corresponding outer cross-member, a supply manifold for the corresponding outer compressor cylinders.

The cross-members must be provided with guide means. A first solution consists of providing them with bearings sliding on fixed guide tubes. However, for a high-powered installation, it is more advantageous to constitute the guide means by one or several tubes fixed to the cross-member and moving in fixed bearings whose distance is equal to at least four times the diameter of the tube. If this solution slightly increases the weight of the movable mechanisms, it has on the other hand the advantage of avoiding any journal, lining and movable oil inlet and of permitting the moving mechanisms to be rendered substantially symmetrical with respect to the longitudinal axis of the machine.

The invention will be better understood on reading the description which follows of a multi-tandem machine which constitutes thereof a particular embodiment given by way of non-limiting example. The description refers to the drawings which accompany it, in which;

FIG. 1 is a view in elevation of the left-hand part of the machine,

FIG. 2 is a schematic diagram showing the arrangement of the axes of the drive cylinders and of the compressor cylinders of the machine of FIG. 1, viewed as a whole.

Figure 3:
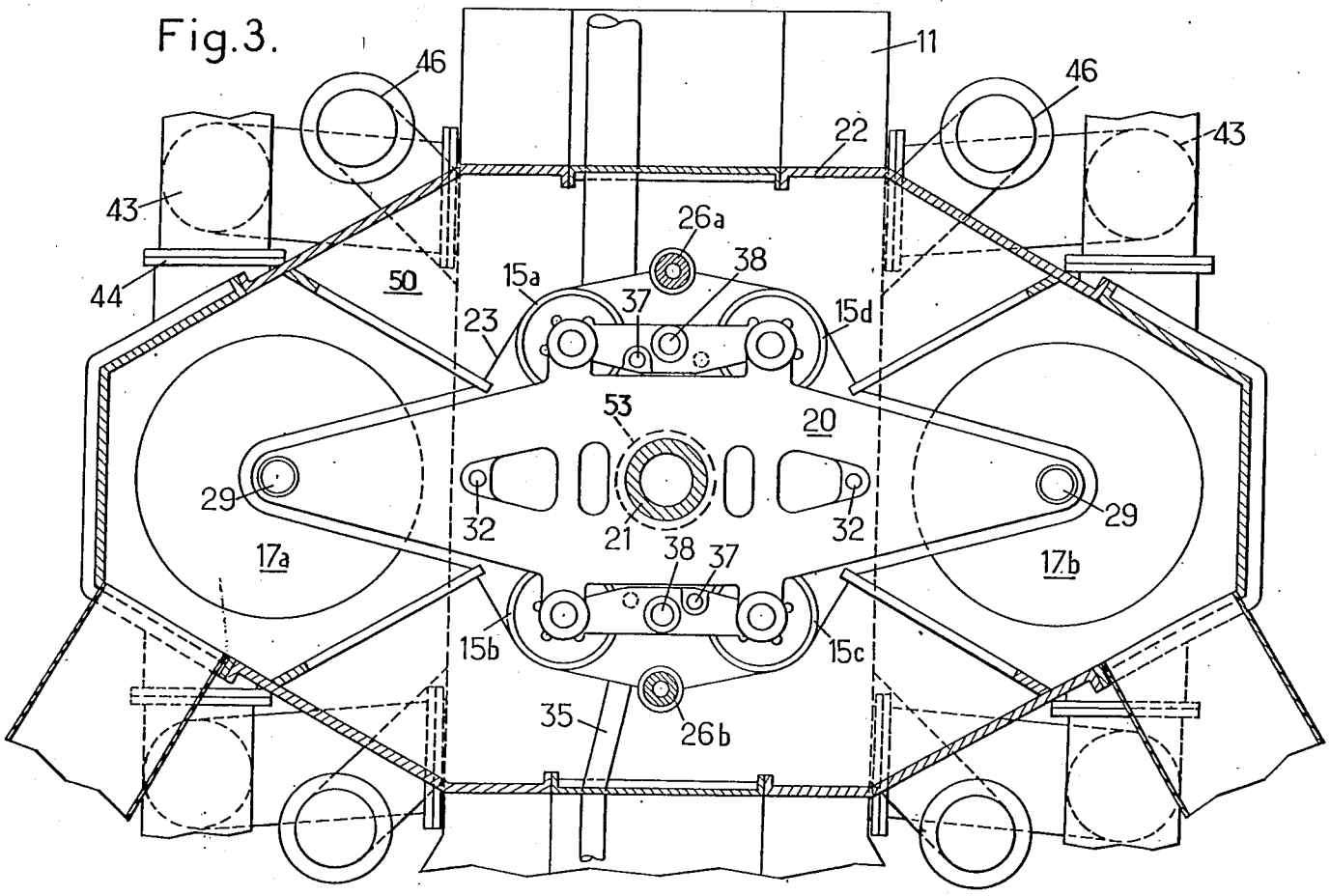
FIGS. 3, 4 and 5 are sectional views along the lines III—III, IV—IV, and V—V of FIG. 1.

The machine shown in FIG. 1 comprises a mounting, an inner moving mechanism and an outer moving mechanism, as well as fixed pipes for the circulation of gases.

The mounting comprises a base 10 and an upper header 11 substantially of the same length, connected by an inner one-piece structure 12 and two frames 13, arranged symmetrically with respect to the middle plane III. This constitution, completed by cruciform structures 14, gives the mounting very great rigidity.

The mounting bears, by means which will be described below, four drive cylinders, of which two, 15*a* and 15*b* appear in FIG. 1, on each side of the middle plane III. The axes of the four cylinders 15*a*, 15*b*, 15*c* and 15*d* are arranged at the corners of a rectangle 16 which, in the embodiment illustrated, is positioned with its large side vertical. Two inner double-acting compressor cylinders 17*a* and 17*b* are mounted one on each side of the central one-piece structure 12. According to the invention, the axes of these cylinders 17*a* and 17*b* intersect the small median 18 of the rectangle 16. To each frame 13 are fixed two compressor cylinders 18*a* and 18*b* also double-acting. The axes of these cylinders 18*a* and 18*b* intersect the large median 19 of the rectangle 16, outside the latter.

The structure of the manifolds positioned around the compressors and the valves, will not be described here, considering that it may be one of those already known, for example that described in U.S. Pat. No. 3,669,571 to which reference may be had.

The constitution of the inner movable mechanism and that of the outer movable mechanism will now be described successively.

The inner movable mechanism unit comprises a central cross-member 20 (FIG. 3) which, due to the fact of the forces to which it is subjected will generally be machined from a single forged part. The cross-member 20 is fixed to an axial guide tube 21, borne by bearings 53 (FIG. 3) separated from one another by a distance that may be equal to three times the diameter of the tube, and fixed to the mounting. The cross-member includes two horizontal opposite arms fixed to the piston rods 29 of the inner compressor cylinders 17*a* and 17*b*. Two protuberances of the cross-member are fixed to the piston rods of these inner drive cylinders 15*a*, 15*b*, 15*c* and 15*c*.

The need for lubrication of the parts in relative movement leads to the appearance of an oil fog in the zone close to the cross-member 20. According to the invention, the central one-piece structure enables serious projection and dispersion of lubricant to be avoided. For this, this central structure is constituted by a cage 22, within which is placed a casing 23 envelopping the cross-member and of sufficient axial size to permit the travel of the latter. The casing 23 is provided with passage seals for the rods 29 connecting the cross-member to the pistons. This casing or the cage may carry the bearings 53 of the guide tube 21. The casing 23 and cage 22 define an air manifold 50 for the inner compressor cylinders 17*a*, 17*b*.

Due to the high rigidity of the cage 22, it is possible to fix the inner compressors 17*a* and 17*b* directly to the cage, which permits an improved symmetry of revolution of the inner circuits.

The outer movable unit has a symmetrical constitution with respect to the median plane III. It includes two outer cross-members 24 (FIG. 4) whose span can be made much less than that of the central cross-member 20, which offers several advantages. On the one hand, it tends to balance the weights of the inner and outer mechanisms inherently. On the other hand, the stresses undergone by the outer cross-members are substantially reduced, particularly in the course of the driving phase, when forces of opposite signs are transmitted by the outer motor piston rods 25*a*, 25*b*, 25*c*, and 25*d* and the tie-rods 26*a* and 26*b* connecting the cross-members 24, placed in line with the piston rods of the compressor cylinders 18*a* and 18*b*. This arrangement of tie-rods enables them to pass outside of the central cross-member 20. It is consequently possible to make them of one-piece constitution and to permit relatively easy dismounting of the cross-member 20.

The cross-members 24, like the cross-member 20, are enclosed in a casing 27 provided with sliding seals allowing passage for the piston rods and for the tie-rods. They are provided with guide tubes 28 sliding in bearings (54 (FIG. 4)). These bearings may be borne by the casing 27 or by a cage 30 which surrounds it and reinforces the frame bearing the compressors.

The arrangement of central and outer cross-members which has just been described has considerable advantages with respect to the arrangement which first comes to mind and which consists of aligning the inner and outer compressors.

As indicated above, it is necessary to provide a synchronizing device for the movements of the mechanism. Due to the fact of the great difference in rigidity between the movable mechanisms (the inner mechanism being one piece whilst the outer mechanism is in two halves assembled by tie-rods whose stiffness is necessarily low), the synchronizing device is strained twice per cycle by a brief but intense force.

To absorb this force, an elastic coupling is provided. However excessive elasticity must be avoided, since it causes the appearance of vibration problems. In addition, it must be remembered that any device which causes the appearance of rocking forces on the guide systems is manifested by increased mechanical frictional losses.

In the embodiment illustrated of the machine according to the invention, these problems are avoided by means of a double synchronizing device which tends to avoid the force dissymmetries.

Figure 5:
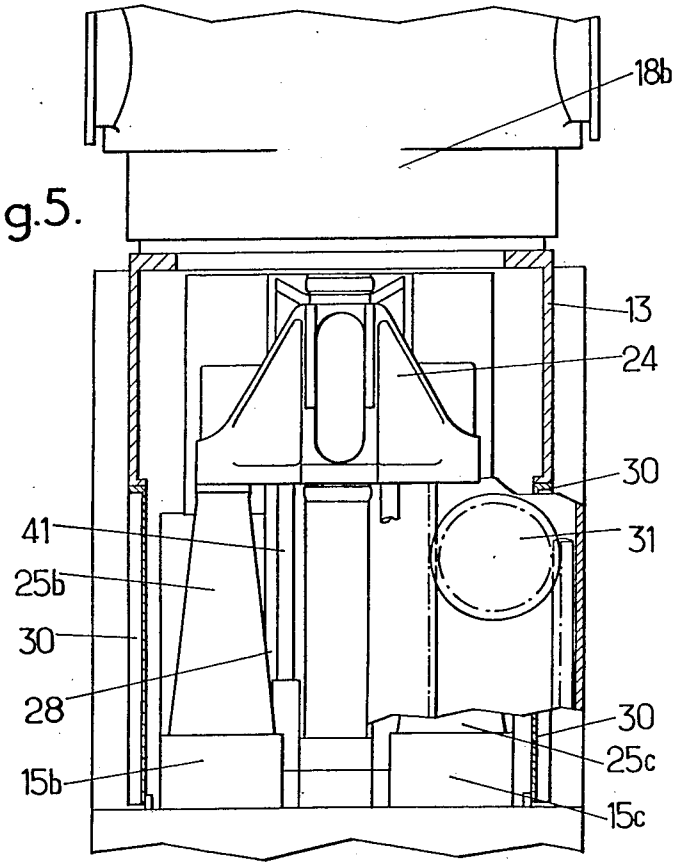

The device comprises two gear wheels 31 (FIGS. 4 and 5) placed in the middle horizontal plane of the machine. Each wheel 31 engages two racks 32 and 33. The racks 32 are fixed to the central cross-member 20 whilst the racks 33 are fixed to one of the outer cross-members 24. The two wheels 31 are placed on the same side of the middle vertical plane of the machine in order not be constitute with the tie-rods 25 a hyperstatic system and they are mounted on bearings having an elasticity enabling shocks to be absorbed.

The fixing of the different cylinders is carried out by means which limit the overhang. As indicated above, the outer compressor cylinders 18*a* and 18*b* are fixed by their inner surface, facing the cross-member 24. This surface is fixed by bolts which may also serve to retain the valve-holder plates, on the corresponding frame 13. This frame, whose depth is close to the thickness of the cross-member 24 is itself fixed to the base 10 and the header 11. It is strengthened in its middle by a cruciform structure located between the drive cylinders which will be described below.

The rigidity of the unit can be increased by connecting the bottoms of the cylinders 18*a* and 18*b* by a plate 34 (FIG. 1)

In this case an overhang persists, but the corresponding forces are negligable compared with the dynamic forces which, themselves, are centered with respect to the means securing the compressors.

The fixing of the inner compressor cylinders 17*a* and 17*b* poses a problem that is not to be found in the case of the outer compressor cylinders 18*a* and 18*b*. In fact, access to the injectors of the drive cylinders must be possible and one must be able to dismount the drive cylinders without considerable prior labor and preferably as a unit.

This result is achieved by means of the presence of the inner one-piece structure 12. The compressor cylinders 17*a* and 17*b* are fixed through flanges to the lateral parts of cage 22, provided for this purpose of thick sheet metal (40 mm for example).

Due to this arrangement, the compressor cylinders can have a true rotational symmetry as regards the cooling water circuits and the envelope of compressed air that they deliver, which is very favorable to a reduction in the thermal stresses.

Figure 7:
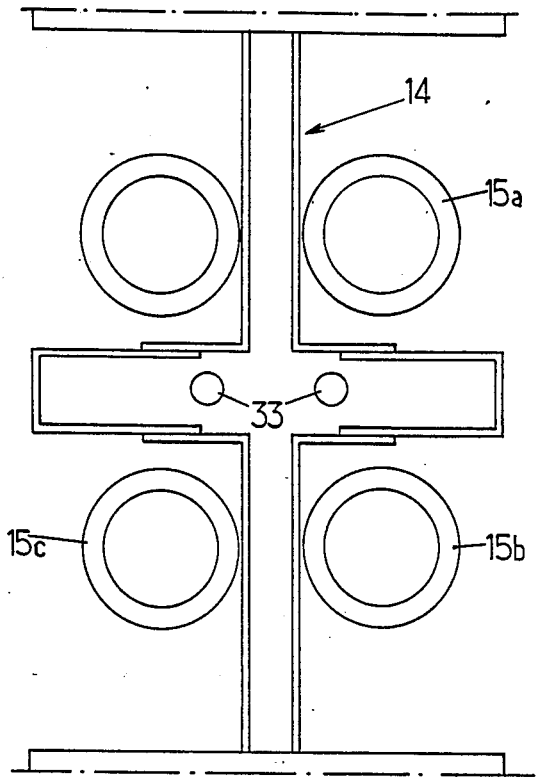
FIG. 7 is a schematic cross-section parallel to that of FIG. 3 and indicating the relative arrangement of the cruciform structure of the frame and compressor cylinders.

Lastly, the drive cylinders 15*a* to 15*d* are each placed in one of the dihedral angles of the cruciform structure 14. That cruciform structure (FIGS. 1 and 7) is provided on only part of the length of the frame, whereby it is possible to insert the drive cylinders and access may easily be had to the injectors 55, as indicated in more detail hereunder. They can be introduced by simple translation and rotation in the horizontal plane. They are thus introduced into their scavenging manifold, previously fixed to the one-pieced structure. Advantageously there is provided, around the water envelope of the central ring of each drive cylinder, a support facilitating fastening.

The mechanical arrangements which have just been described enable particularly advantageous fluid circuits to be achieved and which permit the use of complex thermodynamic cycles, conducive to a high yield.

Figure 4:
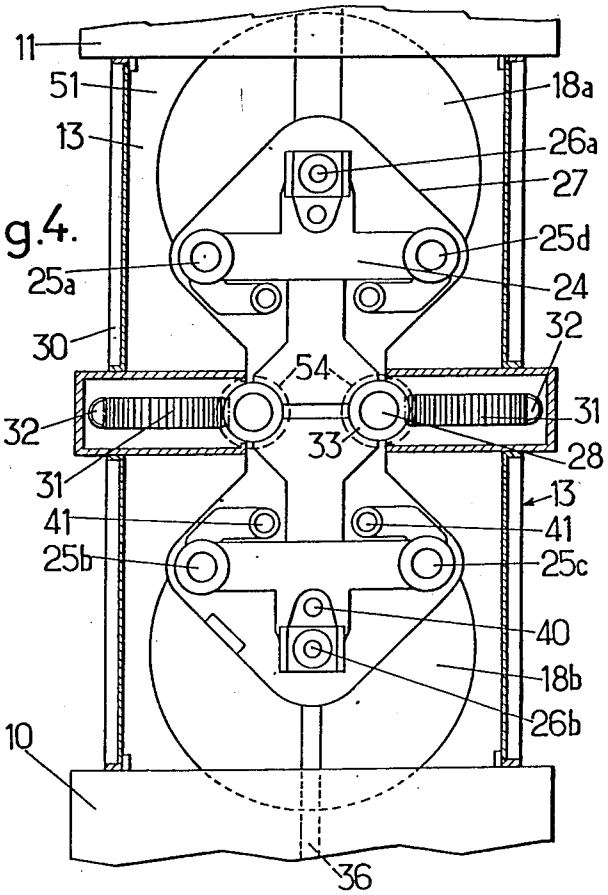
Figure 6:
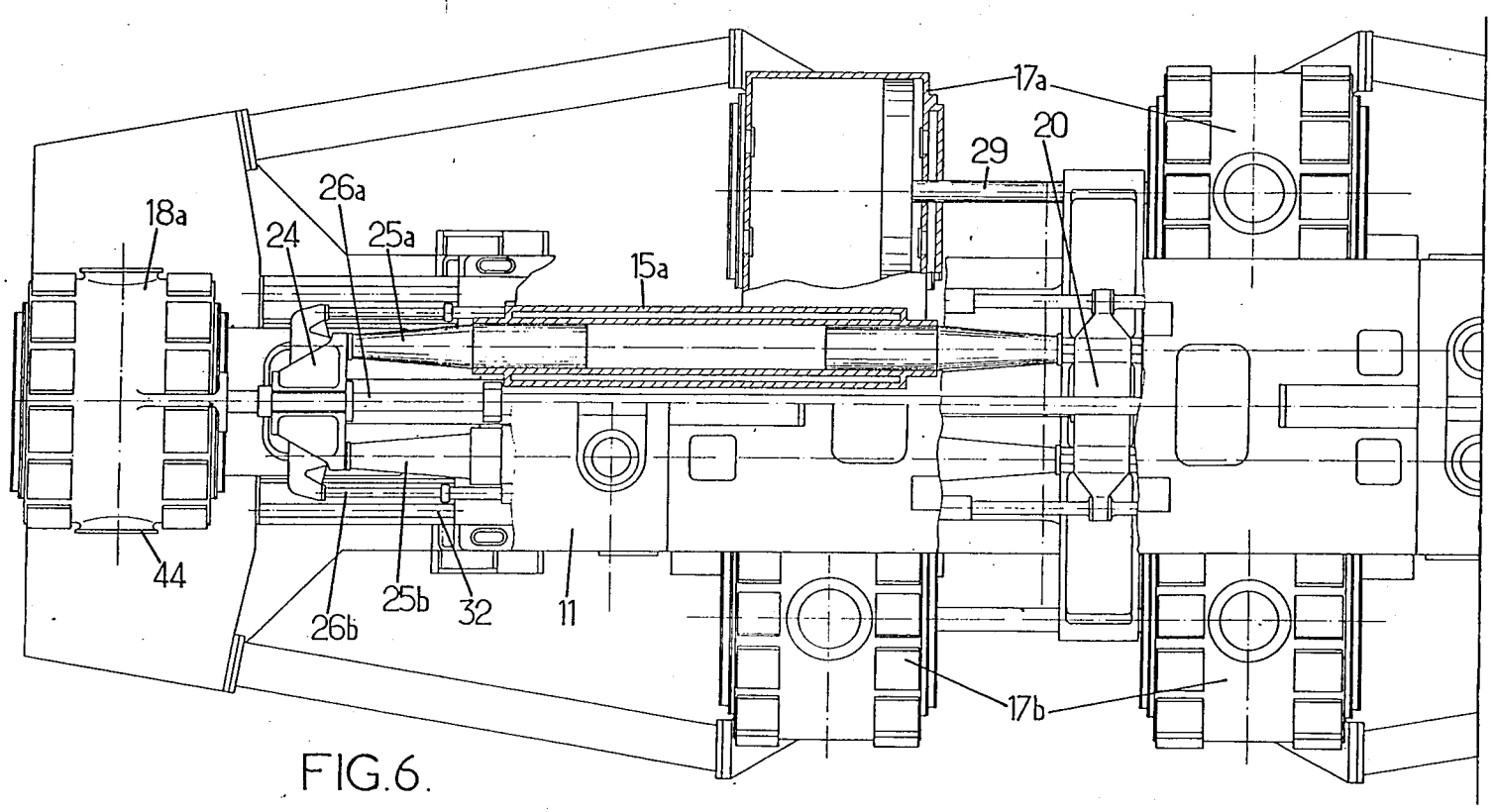
FIG. 6 shows the machine of FIG. 1, as seen from above.

It will be noted firstly that the presence of the casings 23 and 27 enables lubricating oil to be collected from the bearing bushes, hence the losses and contamination by the oil to be reduced. The oil is collected at the bottom of the casings 23 and 27 and it is removed by automatic scavenging valves before being remixed with the surplus oil from the drive cylinders. Such oil outlets 35 and 36 are seen in FIGS. 3 and 4.

This cooling water circulation of the drive pistons is effected through the inside of the piston rods and of the lines borne by the cross-members. In FIG. 3 are seen the treated water inlet lines 37 for cooling the pistons and water return flow 38. In FIG. 4 are also to be found the inlet lines 40 and cooling water return lines 41 of the outer drive pistons.

The constitution which has just been described lends itself perfectly to the performance of a double cycle with supercharging by turbo-blowers, for example according to the system described in French Patent Application No. 78-22,168. This arrangement makes use of the fact that the compressed air sent directly to the gas expansion turbine, supplemented with the air necessary for driving a turbo-blower, can constitute approximately a half of the flow provided by the compressors. It also makes use of the fact that, to increase the efficiency, it is advantageous to produce this air at the operating pressure of the engines, which permits, for the air directly admitted into the expansion turbine, the driving pressure drop to be avoided. It is notably possible to use an arrangement including four high pressure compressors and four low pressure compressors.

This result is achieved by keeping a simple distribution of the manifolds by grouping the same type of compressors in fours at each end of the machine: the compressors 17*a*, 17*b*, 18*a*, 18*b*, placed to the left of the middle plane, constitute a first group, that may be considered as being at high pressure (HP); the four compressors located on the other side may be considered at medium pressure (MP).

The inner compressor cylinders draw air from manifold 50 (FIG. 3). Each pair of outer compressor cylinders 18*a*, 18*b* draws air from an associated manifold 51 (FIG. 4) defined by base 10, header 11, casing 27, frame 13 and cage 30.

The compressors 18*a*, 18*b*, 17*a* and 17*b*, positioned to the left of the middle plane, that is to say of the HP compressors, deliver into the HP manifolds 43 through flanges 44 offset with respect to the axis (FIGS. 1 and 3). The manifolds 43 are provided with coolants 45 (FIG. 1) and deliver into the scavenging manifolds 46 which in turn supply all the drive cylinders 15*a–d*.

The MP compressor cylinders, positioned to the right of the middle plane, supply a medium pressure manifold (not shown in the Figure). A fraction of the air admitted into this MP manifold is sent to a driving air turbine of the turbo-blower. The remainder of the air is mixed with the exhaust gases coming from the drive cylinders 15*a–d* and supplies a gas turbine coupled to the load, constituted, for example, by an alternator.

I claim:

1. Multi-tandem free piston machine, comprising:

a stationary frame having an horizontal longitudinal axis and substantially symmetrical with respect to a vertical midplane, having a lower base member extending substantially throughout the complete length of the frame and an upper header and a central structure secured to said base member and header, an inner movable unit having a central cross member transverse to said axis and carried by said stationary frame for reciprocation along said axis, two sets of four inner drive pistons connected to said central cross member, movable in respective drive cylinders whose axes are located at the corners of a rectangle and which are secured to said central structure, said two sets being on opposite sides of said central cross member, and two sets of compressor pistons connected to said central cross member, located on opposite sides of said cross member and slidably received in respective double action inner compressor cylinders whose axes are located outside said rectangle and which are securely connected to said central structure;

an outer movable unit comprising two outer cross members, tie rod means connecting said cross members, a set of four outer drive pistons carried by each said outer cross member and movable in four respective outer drive cylinders, each said outer cross member being connected to two compressor pistons slidably received in respective double action outer compressor cylinders whose axes are located outside of said rectangle, and which are each located on the longitudinal side of the respective one of said outer cross members opposed to said midplane;

and means for time synchronizing the reciprocations of the two movable units in operation;

the axes of the two compressor pistons of said inner movable unit being in a plane orthogonal to the plane of the axes of the two compressor pistons of said outer movable unit and separated by a distance which is greater than the distance of the axes of the two compressor pistons of said outer movable unit.

2. Multi-tandem free piston machine according to claim 1 wherein the central integral structure further comprises an air box having connected thereto air intake means for supplying air to said inner compressor cylinders, and wherein said inner compressor cylinders are securely connected to said air box.

3. Multi-tandem free piston machine according to claim 2 further comprising rods secured to said inner drive pistons and interconnecting said inner drive pistons to said central cross member, and wherein the air box comprises a casing accommodating the central cross member, said casing being provided with sealing means slidably receiving said rods.

4. Multi-tandem free piston machine according to claim 1 further comprising two lateral frames connected by respective cruciform structures to said central structure, said outer compressor being fixed at the ends of said lateral frames.

5. Multi-tandem free piston machine according to claim 4 wherein each said cruciform structure comprises planar surfaces forming dihedral angles, and wherein each of the drive cylinders is fixed on one of said dihedral angles of the cruciform structure.

6. Multi-tandem free piston machine according to claim 1 wherein said tie-rod means comprises tie-rods connected to said outer compressor pistons and passing outside of said central cross member.

7. Multi-tandem free piston machine according to claim 1 further comprising a supply manifold for the outer compressor cylinders said supply manifold including said stationary frame, said lower base member, and upper header, said supply manifold defining a space containing one of said outer cross members.

8. Multi-tandem free piston machine according to claim 7 wherein said tie-rods are positioned in the plane spanning the axes of said outer compressor cylinders, and in line with the axes of said outer compressor cylinders.

9. Multi-tandem free piston machine according to claim 7 wherein each of said cross members is provided with guide means comprising fixed bearings and at least one tube fixed to said cross member and movable on said bearings.

10. Multi-tandem free piston machine according to claim 9 wherein said means for time synchronizing the reciprocations of the two movable units in operation comprises wheels, said wheels engaging teeth formed on said tube, said wheels being symmetrically arranged so as to improve the synchronizing efficiency.

* * * * *